US006688114B2

(12) United States Patent
Nierenberg

(10) Patent No.: US 6,688,114 B2
(45) Date of Patent: Feb. 10, 2004

(54) LNG CARRIER

(75) Inventor: Alan B. Nierenberg, Tampa, FL (US)

(73) Assignee: El Paso Corporation, Houston, TX (US)

( * ) Notice: Subject to any disclaimer, the term of this patent is extended or adjusted under 35 U.S.C. 154(b) by 0 days.

(21) Appl. No.: 10/112,994

(22) Filed: Mar. 29, 2002

(65) Prior Publication Data

US 2003/0182948 A1 Oct. 2, 2003

(51) Int. Cl.[7] ..... F17C 9/02
(52) U.S. Cl. ..... 62/50.2; 62/50.7
(58) Field of Search ..... 62/45.1, 50.1, 62/50.2, 50.7, 53.2

(56) References Cited

U.S. PATENT DOCUMENTS

| | | | | |
|---|---|---|---|---|
| 2,795,937 A | | 6/1957 | Sattler et al. | |
| 2,938,359 A | | 5/1960 | Cobb, Jr. et al. | |
| 2,940,268 A | | 6/1960 | Morrison | |
| 3,197,972 A | | 8/1965 | King | |
| 3,535,885 A | | 10/1970 | Frijlink et al. | |
| 3,724,229 A | | 4/1973 | Seliber | |
| 3,897,754 A | | 8/1975 | Jerde | |
| 3,978,663 A | | 9/1976 | Mandrin et al. | |
| 3,986,340 A | | 10/1976 | Bivins, Jr. | |
| 4,033,135 A | | 7/1977 | Mandrin | |
| 4,170,115 A | | 10/1979 | Ooka et al. | |
| 4,219,725 A | | 8/1980 | Groninger | |
| 4,224,802 A | | 9/1980 | Ooka et al. | |
| 4,231,226 A | | 11/1980 | Griepentrog | |
| 4,292,062 A | | 9/1981 | Dinulescu et al. | |
| 4,331,129 A | | 5/1982 | Hong et al. | |
| 4,693,304 A | * | 9/1987 | Volland | 165/88 |
| 5,457,951 A | | 10/1995 | Johnson et al. | |
| 5,762,119 A | | 6/1998 | Platz et al. | |
| 6,089,022 A | | 7/2000 | Zednik et al. | |
| 6,116,031 A | | 9/2000 | Minta et al. | |
| 6,164,247 A | | 12/2000 | Iwasaki et al. | |
| 2001/0008126 A1 | | 7/2001 | Iwasaki et al. | |

FOREIGN PATENT DOCUMENTS

| | | |
|---|---|---|
| DE | 3225299 | 1/1984 |
| EP | 048316 | 5/1981 |
| JP | 52010910 | 1/1977 |
| JP | 52010911 | 1/1977 |
| JP | 53115666 | 10/1978 |
| JP | 53126003 | 11/1978 |
| JP | 54022404 | 2/1979 |
| JP | 54136413 | 10/1979 |
| JP | 54136414 | 10/1979 |
| JP | 56015801 | 2/1981 |
| JP | 56074190 | 6/1981 |

(List continued on next page.)

OTHER PUBLICATIONS

California Coastal Commission, "Offshore LNG Terminal Study", Sep. 15. 1978.
Calfornia Coastal Commssion, "Final Report Evaluating and Ranking LNG Terminal Sites", May 24, 1978.
Zednik, J.J., "Shipboard Regasification Terminal", Hydrocarbon Engineering, Oct. 1998.

*Primary Examiner*—Henry Bennett
*Assistant Examiner*—Malik N. Drake
(74) *Attorney, Agent, or Firm*—Squire, Sanders & Dempsey L.L.P.

(57) ABSTRACT

An improvement to an LNG carrier having a vaporizer on board said LNG carrier for vaporizing the LNG to a gaseous state is disclosed. The LNG carrier includes a source of heat for said vaporizer; an intermediate fluid circulating between said vaporizer and said source of heat; and one or more pumps for circulating said intermediate fluid between said vaporizer and said source of heat. The improvement includes equipment connections for adding at least one additional source of heat for said vaporizer, pre-installed flow conduits between said vaporizer and said equipment connections, and valves for isolating said pre-installed flow conduits from said vaporizer.

12 Claims, 5 Drawing Sheets

FOREIGN PATENT DOCUMENTS

| | | |
|---|---|---|
| JP | 58005598 | 1/1983 |
| JP | 59166799 | 9/1984 |
| JP | 61038300 | 2/1986 |
| JP | 62141398 | 6/1987 |
| JP | 1069898 | 3/1989 |
| JP | 05332499 | 12/1993 |
| JP | 09014869 | 1/1997 |
| JP | 11125397 | 5/1999 |
| JP | 11148599 | 6/1999 |
| JP | 2001263592 | 9/2001 |
| WO | WO 99/47869 | 9/1999 |
| WO | WO 01/03793 | 1/2001 |

* cited by examiner

EXPANSION TANK 5
3
3
3
A/C
A/C
A/C
4
PUMP
1
HULL OF VESSEL
KEEL COOLER
2

23
24
LNG
NG
PUMP
25
VAPORIZER
22
SUBMERGED HEAT
EXCHANGER(S)
21

Steam
31

26
STEAM HEATER
43
41
51
42
32
Condensate
23
LNG
NG
VAPORIZER
22
46
52
45
44
62
61
SEAWATER OUTLET
SEAWATER INLET
21
SUBMERGED HEAT EXCHANGER(S)

LNG CARRIER

FIELD OF THE INVENTION

The invention relates to the transportation and regasification of liquefied natural gas (LNG).

BACKGROUND OF THE INVENTION

Natural gas typically is transported from the location where it is produced to the location where it is consumed by a pipeline. However, large quantities of natural gas may be produced in a country in which production by far exceeds demand. Without an effective way to transport the natural gas to a location where there is a commercial demand, the gas may be burned as it is produced, which is wasteful.

Liquefaction of the natural gas facilitates storage and transportation of the natural gas. Liquefied natural gas ("LNG") takes up only about 1/600 of the volume that the same amount of natural gas does in its gaseous state. LNG is produced by cooling natural gas below its boiling point (−259° F. at ambient pressures). LNG may be stored in cryogenic containers either at or slightly above atmospheric pressure. By raising the temperature of the LNG, it may be converted back to its gaseous form.

The growing demand for natural gas has stimulated the transportation of LNG by special tanker ships. Natural gas produced in remote locations, such as Algeria, Borneo, or Indonesia, may be liquefied and shipped overseas in this manner to Europe, Japan, or the United States. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. To regasify the LNG, the temperature is raised until it exceeds the LNG boiling point, causing the LNG to return to a gaseous state. The resulting natural gas then may be distributed through a pipeline system to various locations where it is consumed.

For safety, ecological, and/or aesthetic considerations, it has been proposed that regasification of the LNG take place offshore. A regasification facility may be constructed on a fixed platform located offshore, or on a floating barge or other vessel that is moored offshore. The LNGC may be either docked or moored next to the offshore regasification platform or vessel, so that LNG may then be offloaded by conventional means for either storage or regasification. After regasification, the natural gas may be transferred to an onshore pipeline distribution system.

It also has been proposed that regasification take place onboard the LNGC. This has certain advantages, in that the regasification facility travels with the LNGC. This can make it easier to accommodate natural gas demands that are more seasonal or otherwise vary from location to location. Because the regasification facility travels with the LNGC, it is not necessary to provide a separate LNG storage and regasification facility, either onshore or offshore, at each location at which LNG may be delivered. Instead, the LNGC fitted with regasification facilities may be moored offshore and connected to a pipeline distribution system through a connection located on an offshore buoy or platform.

When the regasification facility is located onboard the LNGC, the source of the heat used to regasify the LNG may be transferred by use of an intermediate fluid that has been heated by a boiler located on the LNGC. The heated fluid may then be passed through a heat exchanger that is in contact with the LNG.

It also has been proposed that the heat source be seawater in the vicinity of the LNGC. As the temperature of the seawater is higher than the boiling point of the LNG and the minimum pipeline distribution temperature, it may be pumped through a heat exchanger to warm and regasify the LNG. However, as the LNG is warmed, regasified, and superheated, the seawater is chilled as a result of the heat transfer between the two fluids. Care must be taken to avoid cooling the seawater below its freezing point. This requires that the flow rates of the LNG being warmed and the seawater being used to warm the LNG be carefully controlled. Proper balancing of the flow rates is affected by the ambient temperature of the seawater, as well as the desired rate of gasification of the LNG. Ambient temperature of the seawater can be affected by the location where the LNGC is to be moored, the time of year when delivery occurs, the depth of the water, and even the manner in which the chilled seawater from warming the LNG is discharged. Moreover, the manner in which the chilled seawater is discharged may be affected by environmental considerations, e.g., trying to avoid an undesirable environmental impact such as ambient water temperature depression in the vicinity of the chilled seawater discharge. Environmental concerns can affect the rate at which the LNG may be heated, and, therefore, the volume of LNG that can be gasified in a given period of time with regasification equipment on board the LNGC.

SUMMARY OF INVENTION

In one aspect, the present invention relates to an LNGC that has a regasification system that includes an onboard vaporizer for vaporizing the LNG, a primary source of heat, and preinstalled lines and locations for adding one or more secondary or alternate sources of heat to the vaporizer and the equipment associated with such secondary or alternate sources of heat.

DETAILED DESCRIPTION

Various improvements can be made to the manner in which LNG is regasified onboard an LNGC. Specifically, there are other sources of heat, components for heat transfer, and combinations of heat sources, that can be used to provide additional flexibility with respect to the locations and the environmental impact of the onboard LNGC regasification.

Figure 1:
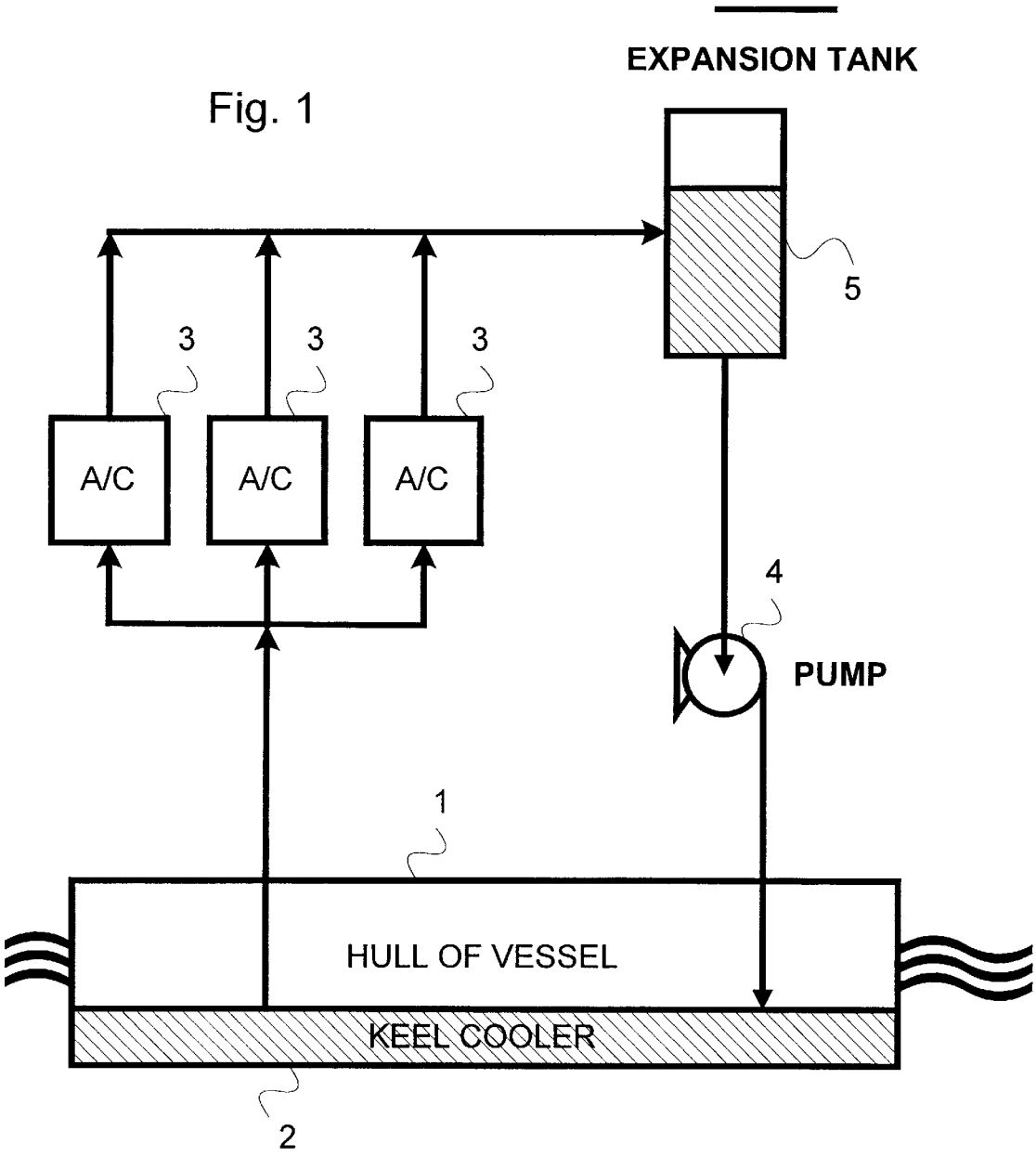
FIG. 1 is a schematic of a prior art keel cooler system.

Devices commonly referred to as "keel coolers" have been used in the past to provide a source of cooling for marine equipment, such as propulsion engine coolers and air conditioning. As shown in FIG. 1, the keel cooler 2 is a submerged heat exchanger that typically is located on or near the bottom of the ship's hull 1, and uses ocean water as a "heat sink" for the heat generated by onboard equipment (such as marine air conditioning units 3) that requires cooling capacity.

The keel cooler 2 operates by either using one or more pods (not shown) that are either built into the lower part of the hull 1 or attached to the exterior of the hull 1 as a heat exchanger that cools an intermediate fluid (such as fresh water or a glycol) that is circulated by pump 1 through the pod. This intermediate fluid is then pumped to one or more locations on the ship to absorb excess heat. Such keel coolers are available commercially from manufacturers such as R. W. Fernstrum & Co. (Menominee, Mich.) and Duramax Marine LLC (Hiram, Ohio).

Among the advantages of such a system, as compared to a system that brings in and subsequently discharges seawater used as a cooling fluid, is the reduced sinking hazard and corrosion hazard that is associated with the circulation of the seawater to various locations onboard the ship. Only the exterior of the keel cooler pod 2 is exposed to the seawater, fresh water, or another relatively non-corrosive fluid that is circulated through the remainder of what amounts to a closed system. Pumps, piping, valves, and other components in the closed loop system do not need to be manufactured from more exotic materials that would be resistant to sea water corrosion. Keel coolers 2 also obviate the need for filtering the seawater, as may be required in a system that passes seawater into the interior of the shipboard machinery components.

Figure 2:
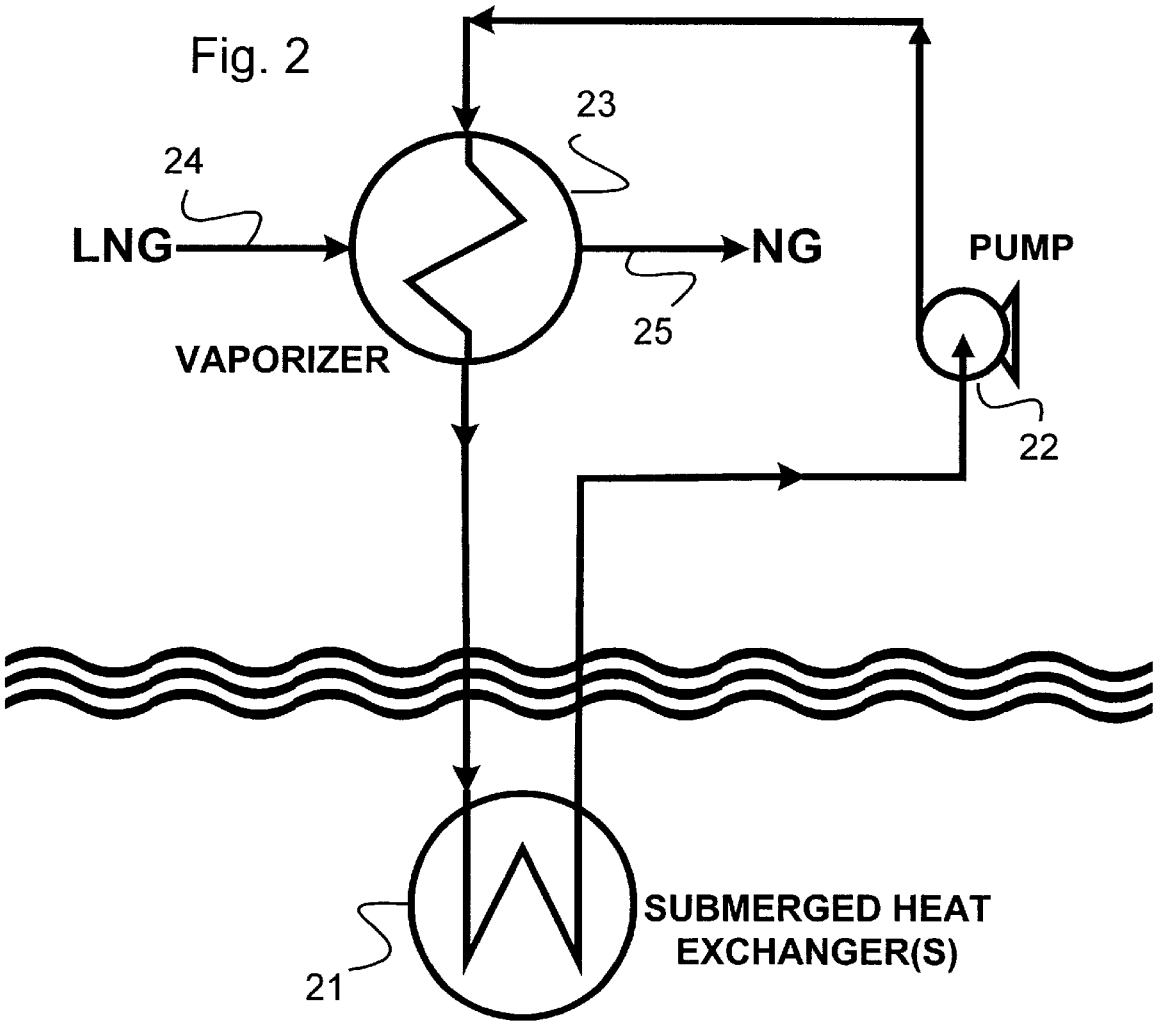
FIG. 2 is a schematic of a submerged heat exchanger used as a source of heat for the vaporizer.

As shown in FIG. 2, in one preferred embodiment of the invention, one or more primary sources of heat, which are preferably submerged heat exchangers 21, are employed—not to provide cooling capacity, but instead to provide heating capacity for the closed loop circulating fluid, which in turn is used to regasify the LNG.

Figure 4A:
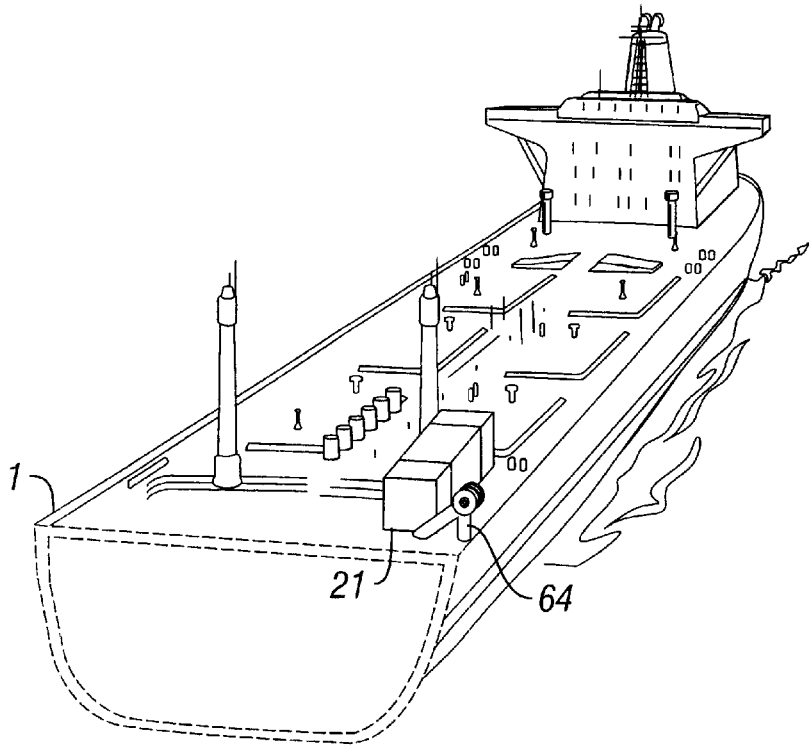
FIG. 4A is a partial cross-section of the LNGC at approximately mid-ship, showing the heat exchanger stored on deck.
Figure 4B:
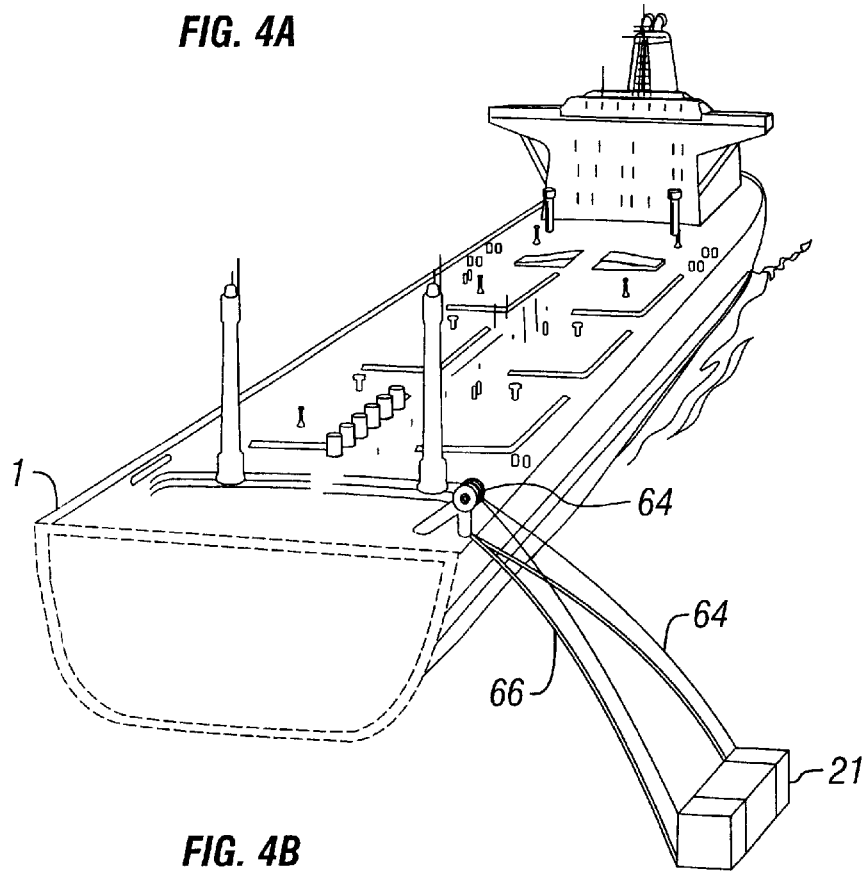
FIG. 4B is a partial cross-section of the LNGC at approximately mid-ship, showing the heat exchanger lowered into the water.

In the preferred embodiment, the heat exchangers 21, instead of being mounted in the ship hull 1 like a traditional keel cooler, are separate heat exchangers 21 that are lowered into the water after the LNG vessel reaches its offshore discharge facility or terminal. In the most preferred embodiment, two heat exchangers 21 are used, each of which is about 20 feet by 20 feet by 40 feet, and collectively meet the heating needs of the LNGC. Each of these heat exchangers 21 has the capacity of about 100 conventional keel coolers. The heat exchangers 21 are connected to the LNGC by suitable piping 66, which may be flexible or rigid. Referring to FIGS. 4A and 4B, the heat exchangers 21 are preferably stored on deck when not in use (see FIG.4A), and may be stored under a cover, in a shed, or in some other structure (not shown). At time of use, the heat exchangers 21 are lowered by mechanical equipment 64, such as, but not limited to, a winch system or elevator system, which equipment is well known to those skilled in the art (see FIG. 4B). After lowering the heat exchangers 21 into the water, rigid attachment of the heat exchangers 21 to the ship is preferred where there is concern that the heat exchangers 21 might bump against the ship.

Figure 5:
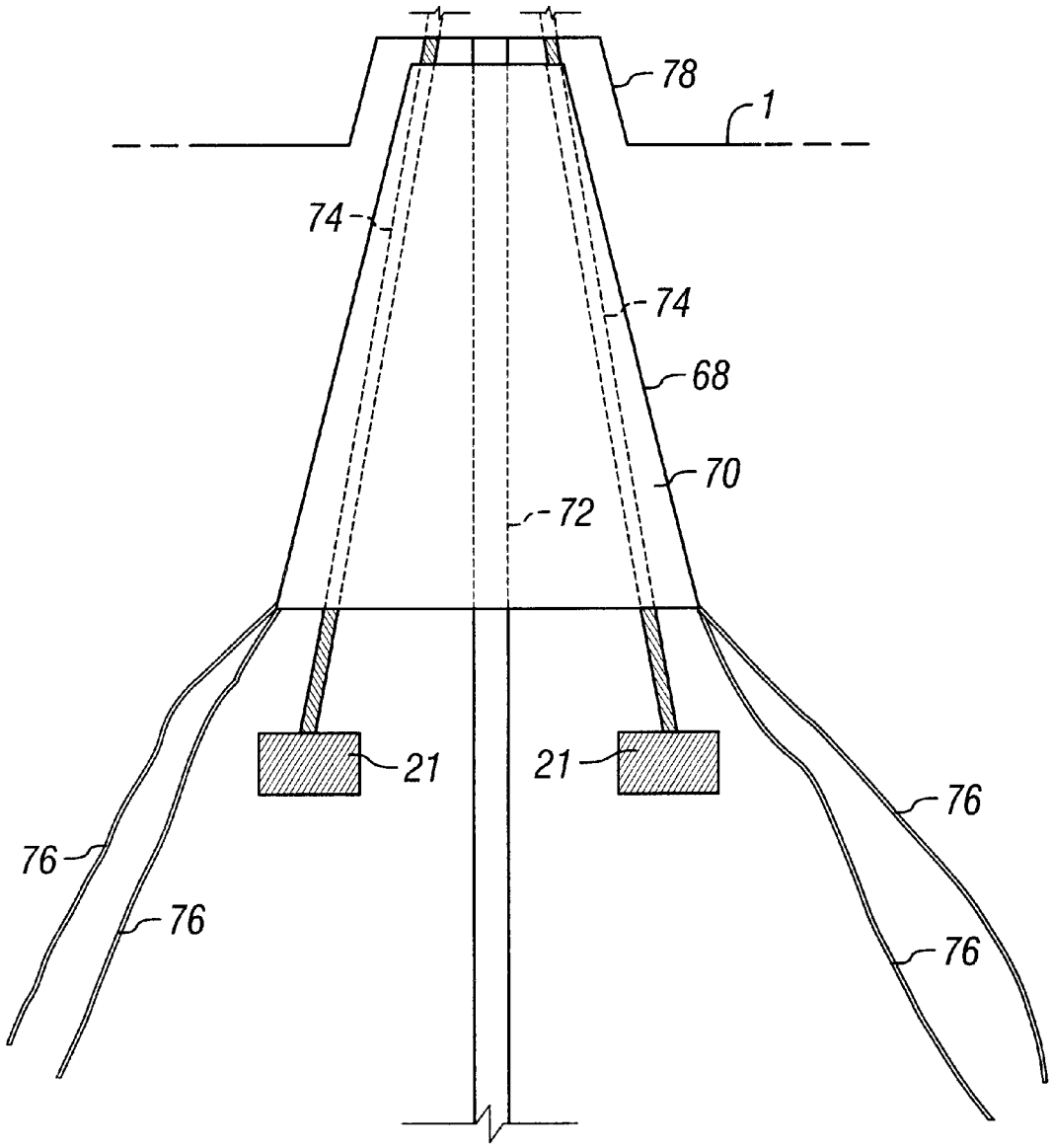
FIG. 5 is a partial cross-section of an alternative preferred embodiment of the LNGC, showing the ship hull integrally moored on a buoy, and two heat exchangers attached to the mooring buoy and fluidly connected to the LNGC after it moors to the buoy.

In another preferred embodiment, the heat exchangers 21 are permanently submerged installations at the offshore discharge terminal. For example, the submerged heat exchanger system 21 may be mounted to the buoy 68 that is used to moor the LNGC. Either of these alternative heat exchanger 21 configurations (FIG. 4B, 5) is connected to the LNGC so as to allow the intermediate fluid to be circulated through the submerged heat exchangers 21.

When the heat exchangers 21 are attached to a mooring buoy 68, an LNGC turret recess 78 mates with the buoy 68, permitting the LNGC to rotate around the buoy 68. The heat exchangers 21 are connected by lines 74 to the ship hull 1, and thereby fluidly connected to the vaporizer 23 and to any secondary sources of heat 26. A gas pipe riser 72 connects the LNGC and a pipeline distribution system for offloading the regasified LNG.

In another embodiment of the invention, one or more submerged heat exchanger units 21 are located at any suitable location below the waterline of the hull 1, and are mounted directly within the hull 1 of the LNGC. Alternatively, the heat exchangers 21 may be partially, rather than fully, submerged.

An intermediate fluid, such as glycol, propane or fresh water, is circulated by a pump 22 through the vaporizer 23 and the submerged heat exchangers 21. Other intermediate fluids having suitable characteristics, such as acceptable heat capacity and boiling points, also may be used and are commonly known in the industry. LNG is passed into the vaporizer 23 through line 24 where it is regasified and exits through line 25.

The submerged heat exchangers 21 enable heat transfer from the surrounding seawater to the circulated intermediate fluid without the intake or pumping of seawater into the LNGC, as mentioned above. The size and surface area of the heat exchangers 21 may vary widely, depending upon the volume of LNG cargo being regasified for delivery and the temperature ranges of the water in which the LNGC makes delivery of natural gas.

For example, if the temperature of the circulated intermediate fluid is approximately 45° F. upon return to the submerged heat exchangers 21 and the seawater temperature is about 59° F., the temperature differential between the two is about 14° F. This is a relatively modest temperature differential, and, accordingly, the heat exchangers 21 will require a larger surface area to accommodate the heat transfer needs of the present invention, as compared to the typical keel coolers described above, which were designed for the rejection of a few million BTUs per hour.

In one preferred embodiment, two submerged heat exchangers 21, collectively designed to absorb approximately 62 million BTUs per hour and having approximately 450,000 square feet of surface area are used. These heat exchangers 21 are about 20 feet by 20 feet by 40 feet and preferably contain bundles of tubes that are exposed to permit water to pass over them, while intermediate fluid circulates inside the tubes. This quantity of surface area may be arranged in a variety of configurations, however, including, in the preferred embodiment, multiple tube bundles arranged similarly to those in conventional keel coolers 2. The heat exchanger 21 of the present invention may also be a shell and tube heat exchanger, a bent-tube fixed-tube-sheet exchanger, spiral tube exchanger, plate-type exchanger, or other heat exchangers commonly known by those skilled in the art that meet the temperature, volumetric and heat absorption requirements for the LNG to be regasified.

The vaporizer 23 preferably is a shell and tube vaporizer, and such a vaporizer 23 is schematically depicted in FIG. 2. This type of vaporizer 23 is well known to the industry, and is similar to several dozen water heated shell and tube vaporizers in service at land-based regasification facilities. Other types of vaporizers that may be used include, but are not limited to, intermediate fluid vaporizers and submerged combustion vaporizers. In alternative shipboard applications, where seawater may be one of the heating mediums or may contact the equipment, the vaporizer 23 is preferably made of a proprietary AL-6XN super-austenitic stainless steel (ASTM A-240, B688, UNS N08367) for wetted surfaces in contact with seawater and type 316L stainless steel for all other surfaces of the vaporizer 23. A variety of materials may be used for the vaporizer, including but not limited to titanium alloys and compounds.

In the preferred embodiment, a shell and tube vaporizer 23 is used that produces about 100 million standard cubic feet per day ("mmscf/d") of LNG with a molecular weight of about 16.9. For example, when operating the LNGC in seawater with a temperature of about 59° F. and an intermediate fluid temperature of about 45° F., the vaporizer 23 will require a heated water flow of about 2,000 cubic meters per hour. The resulting heat transfer of approximately 62 million BTUs per hour is preferably achieved using a single tube bundle of about forty foot long tubes, preferably about ¾ inch in diameter. Special design features are incorporated in the vaporizer 23 to assure uniform distribution of LNG in the tubes, to accommodate the differential thermal contraction between the tubes and the shell, to preclude freezing of the heating water medium, and to accommodate the added loads from shipboard accelerations. In the most preferred embodiment, parallel installation of 100 mmscf/d capacity vaporizers 23 are arranged to achieve the total required output capacity for the regasification vessel. Suppliers of these types of vaporizers 23 in the U.S. include Chicago Power and Process, Inc. and Manning and Lewis, Inc.

In the preferred embodiment of the invention, the circulating pumps 22 for the intermediate fluid are conventional single stage centrifugal pumps 22 driven by synchronous speed electrical motors. Single stage centrifugal pumps 22 are frequently used for water/fluid pumping in maritime and industrial applications, and are well known to those skilled in the art. The capacity of the circulating pumps 22 is selected based upon the quantity of vaporizers 23 installed and the degree of redundancy desired.

For example, to accommodate about a 500 million standard cubic feet per day ("mmscf/d") design capacity, a shipboard installation of six vaporizers 23, each with a capacity of about 100 mmscf/d each, is made, providing a redundant vaporizer. The required total heating water circulation for this system is about 10,000 cubic meters per hour at the design point, and about 12,000 cubic meters per hour at the peak rating. Taking shipboard space limitations into consideration, three pumps 22, each with a 5,000 cubic meter per hour capacity are used and provide a fully redundant unit at the design point circulation requirements of 10,000 cubic meters per hour. If five vaporizers are used, then only two pumps are required. These pumps 22 have a total dynamic head of approximately 30 meters, and the power requirement for each pump 22 is approximately 950 kW (kilowatts). The suction and discharge piping for each pump 22 is preferably 650 mm diameter piping, but piping of other dimensions may be used.

The materials used for the pumps 22 and associated piping preferably can withstand the corrosive effects of seawater, and a variety of materials are available. In the preferred embodiment, the pump casings are made of nickel aluminum bronze alloy and the impellers have Monel pump shafts. Monel is a highly corrosive resistant nickel based alloy containing approximately 60–70% nickel, 22–35% copper, and small quantities of iron, manganese, silicon and carbon.

While the preferred embodiment of the invention is drawn to a single stage centrifugal pump 22, a number of types of pumps 22 that meet the required flow rates may be used and are available from pump suppliers. In alternative embodiments, the pumps 22 may be smooth flow and pulsating flow pumps, velocity-head or positive-displacement pumps, screw pumps, rotary pumps, vane pumps, gear pumps, radial-plunger pumps, swash-plate pumps, plunger pumps and piston pumps, or other pumps that meet the discharge head and flow rate requirements of the intermediate fluid. Drives for the pumps may be hydraulic motors, diesel engines, DC motors, or other prime movers with requisite speed and power characteristics.

Figure 3:
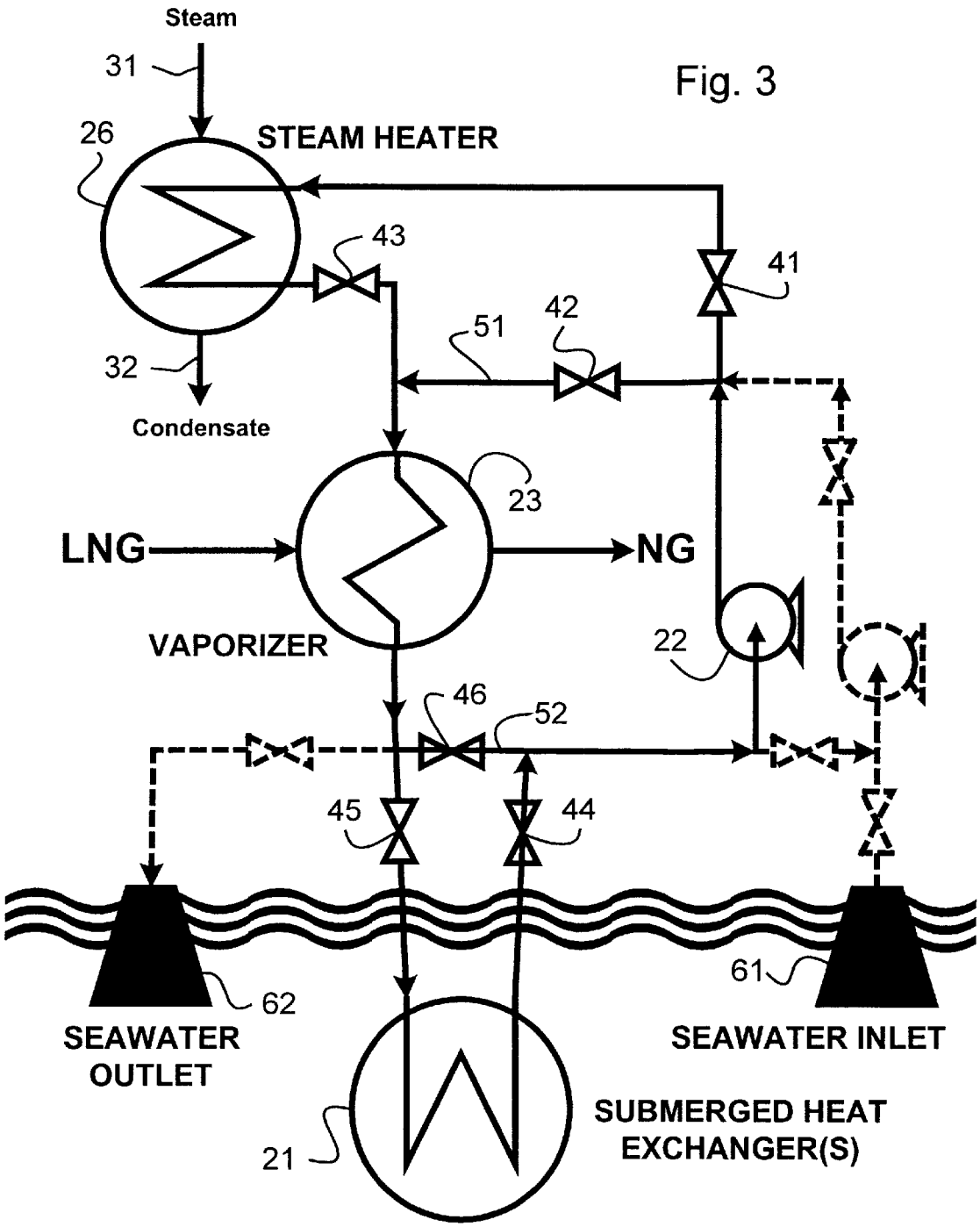
FIG. 3 is a schematic of an alternative dual heat source system.

A submerged or partially submerged heat exchanger system 21 may be used as either the only source of heat for regasification of the LNG, or, in an alternative embodiment of the invention as shown in FIG. 3, may be used in conjunction with one or more secondary sources of heat. In the event that the capacity of the submerged or partially submerged heat exchanger system 21, or the local sea water temperature, are not sufficient to provide the amount of heat required for the desired level of regasification operations, this embodiment of the invention provides operational advantages.

In one preferred alternative embodiment, the intermediate fluid is circulated by pump 22 through steam heater 26, vaporizer 23, and one or more submerged or partially submerged heat exchangers 21. In the most preferred embodiment of the invention, the heat exchanger 21 is submerged. Steam from a boiler or other source enters the steam heater 26 through line 31 and exits as condensate through line 32. Valves 41, 42, and 43 permit the isolation of steam heater 26 and the opening of bypass line 51, which allows the operation of the vaporizer 23 with the steam heater 26 removed from the circuit. Alternatively, valves 44, 45, and 46 permit the isolation of the submerged heat exchanger 21 and the opening of bypass line 52, which allows operation of the vaporizer 23 with the submerged heat exchanger 21 removed from the circuit. The valves used are conventional gate or butterfly valves for isolation purposes and are constructed of materials suitable for the circulated fluid. In the case of seawater, butterfly valves are preferably made of cast steel or ductile iron construction with a resilient liner material, such as neoprene or viton. Gate valves are preferably made of bronze construction with stainless steel or Monel trim.

The steam heater 26 preferably is a conventional shell and tube heat exchanger fitted with a drain cooler to enable the heating of the circulated water, and may provide either all or a portion of the heat required for the LNG regasification. The steam heater 26 is preferably provided with desuperheated steam at approximately 10 bars of pressure and about 360° F. temperature. The steam is condensed and sub-cooled in the steam heater 26 and drain cooler and returned to the vessel's steam plant at approximately 160° F.

In another alternative embodiment, the heating water medium in the steam heater 26 and drain cooler is seawater. A 90–10 copper nickel alloy is preferably used for all wetted surfaces in contact with the heating water medium. Shell side components in contact with steam and condensate are preferably carbon steel.

For the shipboard installation described above, three steam heaters 26 with drain coolers are used, each preferably providing 50% of the overall required capacity. Each steam heater 26 with a drain cooler has the capacity for a heating water flow of about 5,000 cubic meters per hour and a steam flow of about 50,000 kilograms per hour. Suitable steam heat exchangers 26 are similar to steam surface condensers used in many shipboard, industrial and utility applications, and are available from heat exchanger manufacturers worldwide.

The addition of a seawater inlet 61 and a seawater outlet 62 for a flow through seawater system, permit seawater to be used as either a direct source of heat for the vaporizer 23 or as an additional source of heat to be used in conjunction with the steam heater 26, instead of the submerged heat exchangers 21. This is shown in FIG. 3 by the dashed lines.

Alternatively, the submerged or partially submerged heat exchanger system 21 may be used as the secondary source of heat, while another source of heat is used as the primary source of heat for regasification operations. Examples of another such source of heat would include steam from a boiler, or a flow-through seawater system in which seawater is introduced as a source of heat from the ocean (or other body of water in which the LNGC is located) and discharged back into the ocean after being used to heat either the LNG or an intermediate fluid that subsequently is used to heat the LNG. Other sources of heat could include a submerged combustion vaporizer or solar energy. Having a secondary or alternative source of heat in addition to the primary source of heat, whether or not either of the sources is a submerged heat exchanger system, also is considered advantageous.

The use of a primary source of heat coupled with the availability of at least one secondary or additional source of heat provides increased flexibility in the manner in which the LNG may be heated for regasification purposes. The primary source of heat may be used without requiring that source of heat to be scaled up to accommodate all ambient circumstances under which the regasification may take place. Instead, the secondary source of heat may be used only in those circumstances in which an additional source of heat is required.

The availability of a secondary source of heat that is based on an entirely different principal than the primary source of heat also guarantees the availability of at least some heat energy in the event of a failure of the primary heat source. While the regasification capacity may be substantially reduced in the event of a failure of the primary source of heat, the secondary source of heat would provide at least a partial regasification capability that could be used while the primary source of heat is either repaired or the reason for the failure otherwise corrected.

In one embodiment of such a system, the primary source of heat may be steam from a boiler, and the secondary source a submerged heat exchanger system. Alternatively, the primary source of heat may be steam from a boiler, and the secondary source may be the use of an open, flow-through seawater system. Other combinations of sources of heat also may be used depending on availability, economics, or other considerations. Other potential heat sources include the use of hot water heating boilers, or submerged combustion heat exchangers, each of which are commercially available products.

In another embodiment of the system, the LNGC may be equipped with a primary heat source, and made ready for the addition of a secondary heat source by including equipment connections, piping and other items that otherwise could require substantial modification of the ship to accommodate. For example, the LNGC could be equipped to use steam from a boiler as the primary source of heat, but also be equipped with suitable piping, connections, and locations for pumps or other equipment to facilitate the later installation of a submerged heat exchanger system or a flow-through seawater system without requiring major structural modification of the ship itself. While this may increase the initial expense of constructing the LNGC or reduce the capacity of the LNGC slightly, it would be economically preferable to undergoing a major structural modification of the ship at a later date.

The preferred method of this invention is an improved process for regasifying LNG while onboard an LNG carrier. The LNGC, fitted with regasification facilities as described above, may be moored offshore and connected to a pipeline distribution system through a connection located on an offshore buoy or platform, for example. Once this connection is made, an intermediate fluid, such as glycol or fresh water, is circulated by pump 22 through the submerged or partially submerged heat exchanger or heat exchangers 21 and the vaporizer 23. Other intermediate fluids having suitable characteristics, such as acceptable heat capacity and boiling points also may be used as described above.

The heat exchanger 21 is preferably fully submerged and enables heat transfer from the surrounding seawater to the circulated intermediate fluid due to the temperature differential between the two. The intermediate fluid thereafter circulates to the vaporizer 23, which preferably is a shell and tube vaporizer 23. In the preferred embodiment, the intermediate fluid passes through parallel vaporizers 23 to increase the output capacity of the LNGC. LNG is passed into the vaporizer 23 through line 24, where it is regasified and exits through line 25. From line 25, the LNG passes into a pipeline distribution system attached to the platform or buoy where the LNGC is moored.

In the most preferred method of the invention, the intermediate fluid is circulated through submerged heat exchangers 21 that are mounted in one or more structures connected to the LNGC by suitable piping and lowered into the water after the LNGC moors at an offshore buoy or terminal. In yet another alternative method of the invention, the submerged heat exchangers 21 are mounted to the buoy 68 or other offshore structure to which the LNGC is moored, and connected to the ship after docking.

In another preferred method of the invention, one or more secondary or additional sources of heat are provided for regasification of the LNG. In one embodiment, the intermediate fluid is circulated by pump 22 through steam heater 26, vaporizer 23, and one or more submerged or partially submerged heat exchangers 21. Steam from a boiler or other source enters steam heater 26 through line 31 and exits as condensate through line 32. Valves 41, 42 and 43 permit operation of the vaporizer 23 with or without the steam heater 26. In addition, the vaporizer 23 may be operated solely with use of the secondary sources of heat such as the steam heater 26. Valves 44, 45, and 46 permit isolation of these submerged heat exchangers 21, so that the vaporizer 23 may operate without them.

In another method of the invention, a flow through seawater system, with an inlet 61 and an outlet 62, permit seawater to be used as a direct source of heat for the vaporizer 23 or as an additional source of heat to be used in conjunction with the steam heater 26, instead of the submerged heat exchanger 21. Of course, the submerged or partially submerged heat exchanger system 21 may be used as a secondary source of heat, while one of the other described sources of heat is used as the primary source of heat. Examples of this are described above.

Various exemplary embodiments of the invention have been shown and described above. However, the invention is not so limited. Rather, the invention shall be considered limited only by the scope of the appended claims.

What is claimed is:

1. An improved LNG carrier having on board regasification capability of the type wherein said LNG carrier has a vaporizer on board that vaporizes the LNG to a gaseous state, a source of heat for said vaporizer, an intermediate fluid circulating between said vaporizer and said source of heat, and one or more pumps for circulating said intermediate fluid between said vaporizer and said source of heat, the improvement comprising:

a. said source of heat including at least one heat exchanger integral with said LNG carrier, and at least partially submerged in water;

b. equipment connections for adding at least one additional source of heat for said vaporizer;

c. pre-installed flow conduits between said vaporizer and said equipment connections; and d. valves for isolating said pre-installed flow conduits from said vaporizer.

2. The LNG carrier of claim 1, wherein said heat exchanger is fully submerged.

3. The LNG carrier of claim 1, including:

(a) at least two additional sources of heat; and (b) valves and at least one bypass line for isolating at least one of said additional sources of heat from at least one of the remaining sources of heat.

4. An improved LNG carrier having on board regasification capability of the type wherein said LNG carrier has a vaporizer on board that vaporizes the LNG to a gaseous state, a source of heat for said vaporizer, an intermediate fluid circulating between said vaporizer and said source of heat, and one or more pumps for circulating said intermediate fluid between said vaporizer and said source of heat, the improvement comprising:

a. equipment connections for adding at least one additional source of heat for said vaporizer;

b. pre-installed flow conduits between said vaporizer and said equipment connections; and c. valves for isolating said pre-installed flow conduits from said vaporizer, wherein the source of heat is at least one heat exchanger at least partially submerged in water, and wherein said heat exchanger is attached to an exterior surface of the LNG carrier.

5. The LNG carrier of claim 4, wherein said heat exchanger is stored on the LNG carrier and lowered into the water when used.

6. The LNG carrier of claim 5, wherein said heat exchanger is moveably fixed onboard the LNG carrier to permit it to be lowered into the water by mechanical equipment when used.

7. The LNG carrier of claim 4, wherein said heat exchanger is rigidly attached to the LNG carrier after being lowered into the water.

8. The LNG carrier of claim 4, wherein said heat exchanger is flexibly attached to the LNG carrier after being lowered into the water.

9. The LNG carrier of claim 1, wherein said heat exchanger is mounted in a hull of the LNG carrier.

10. An improved LNG carrier having on board regasification capability of the type wherein said LNG carrier has a vaporizer on board that vaporizes the LNG to a gaseous state, a source of heat for said vaporizer, an intermediate fluid circulating between said vaporizer and said source of heat, and one or more pumps for circulating said intermediate fluid between said vaporizer and said source of heat the improvement comprising:

a. said source of heat for regasifying the LNG being mounted in an offshore terminal and equipped to fluidly connect to the LNG carrier b. equipment connections for adding at least one additional source of heat for said vaporizer;

c. pre-installed flow conduits between said vaporizer and said equipment connections; and d. valves for isolating said pre-installed flow conduits from said vaporizer.

11. The LNG carrier of claim 10, wherein said offshore terminal is a mooring buoy.

12. The LNG carrier of claim 10, wherein the source of heat is at least one heat exchanger that is at least partially submerged in water.

* * * * *